United States Patent [19]

Beeck

[11] 4,375,278

[45] Mar. 1, 1983

[54] SELF-TIGHTENING SLEEVE HOLDER

[75] Inventor: Harald Beeck, Remscheid, Fed. Rep. of Germany

[73] Assignee: Barmag Barmer Maschinenfabrik Ag, Remscheid-Lennep, Fed. Rep. of Germany

[21] Appl. No.: 300,124

[22] Filed: Sep. 8, 1981

[30] Foreign Application Priority Data

Sep. 9, 1980 [DE] Fed. Rep. of Germany ..... 3033852

[51] Int. Cl.[3] ..... B65H 54/54

[52] U.S. Cl. ..... 242/46.2; 242/46.6

[58] Field of Search ..... 242/46.4, 46.2, 46.3, 242/46.6, 68, 68.1, 68.2, 68.3, 72 R, 129.5, 129.7, 130, 130.1; 57/129, 130

[56] References Cited

U.S. PATENT DOCUMENTS

| | | | |
|---|---|---|---|
| 1,884,805 | 10/1932 | Moritz | 242/46.2 |
| 2,464,024 | 3/1949 | Carter et al. | 242/46.2 |
| 3,495,781 | 2/1970 | Graf et al. | 242/46.4 |
| 4,049,210 | 9/1977 | Pierce | 242/46.2 X |
| 4,202,507 | 5/1980 | Fisher | 242/46.2 |

FOREIGN PATENT DOCUMENTS

| | | | |
|---|---|---|---|
| 121667 | 1/1967 | Czechoslovakia | 242/46.4 |
| 716045 | 9/1954 | United Kingdom | 242/46.6 |

*Primary Examiner*—Stanley N. Gilreath
*Attorney, Agent, or Firm*—John H. Shurtleff

[57] ABSTRACT

A self-tightening sleeve holder or chuck assembly designed particularly for high speed textile winding machines wherein the bobbin sleeve is releasably held by two elastomeric gripping rings which are stretched or distended radially outwardly in automatic sequence in response to the coordinated movement of a cooperating push tube and push ring actuated by the bobbin sleeve as it is pushed onto the sleeve holder, the gripping rings being moved from a first small diameter bed to a larger diameter bed to securely lock the bobbin sleeve in place.

13 Claims, 3 Drawing Figures

SELF-TIGHTENING SLEEVE HOLDER

BACKGROUND OF THE INVENTION

This invention relates to self-tightening chucks, particularly as used in textile machines for holding bobbin sleeves during winding or spooling operations and the like. In general, the chuck used for this purpose is a sleeve holding device which is mounted on a rotary, cantilevered shaft projecting outwardly from the side of the machine with stop means to receive the inner end of the sleeve facing the machine side and which has releasable clamping or gripping elements to secure the bobbin sleeve in place.

In recent years, the development of spinning machines for the production of synthetic fibers has led to a very substantial increase in spinning speeds, i.e. the winding speeds required to take up the freshly spun filaments or threads. Because of these rapid winding speeds, e.g. over 3,000 m/min and preferably up to 5,000 m/min or more, considerable time and effort have been spent in attempting to reduce as far as possible the amount of waste thread which accumulates during the necessary exchanges of bobbins or spools, i.e. replacing a full bobbin with an empty bobbin sleeve. In order to reduce the time needed to make this exchange, there have been a number of proposals to provide so-called automatic chucks in the form of sleeve holders which have self-tightening characteristics which permit a substantial reduction in the time needed to remove a full bobbin and insert an empty bobbin sleeve. Although the present state of this art offers a number of different self-tightening chuck or sleeve holder constructions, all of them suffer from various disadvantages.

For example, in the German patent specification (DE-AS) No. 1,038,709, there is described a special chuck or bobbin holder for use in spinning machines for producing synthetic threads wherein frictional gripping contact with the bobbin sleeve is produced by a two-arm rocker lever which is spring-actuated when pushing on the bobbin sleeve so as to press the forward end of the two-armed lever against the inner wall of the sleeve. Centrifugal forces, which occur during the winding, are supposed to reinforce the clamping or gripping action of this chuck. Due to the large number of pivot positions required and the open construction of this mechanism, the chuck is unusually subject to fouling and is therefore difficult to operate and maintain under typical working conditions. Moreover, in order to avoid deformation of the bobbin sleeve caused by the point-like pressure of the gripping positions on the sleeve circumference, the contact pressure of each position must be reduced to a value which no longer guarantees the secure holding of the bobbin, especially in handling large and relatively heavy windings.

In a sleeve coupling for twist spindles disclosed by the German patent specification (DE-AS) No. 1,061,242, a rubber ring is used to achieve a frictional locking connection between the sleeve holder and the bobbin sleeve. In its relaxed position, the rubber ring is free of contact with the inner wall of the sleeve, but with the aid of several gripping elements which are pivoted to swing outwardly to the circumference of the holder, the rubber rings are distended or stretched outwardly to make contact with the inner wall of the sleeve. During operation of this spindle, centrifugal forces also act outwardly to stretch the rubber rings and bring them into gripping contact with the sleeve. The greatest disadvantage of this particular sleeve couplings resides in the fact that the sleeve is firmly gripped only at high rotational speeds. At lower speeds or at rest, the bobbin sleeve sits loosely on the spindle and a firm gripping action is not possible, thereby causing problems in unloading the full bobbin and inserting an empty sleeve. Besides, this device permits only a pointwise bracing or gripping of the sleeve which causes deformation of the sleeve wall.

Another winding mandrel with an automatic chucking feature is disclosed in U.S. Pat. No. 3,495,781, corresponding to DE-AS No. 1,574,399, wherein the bobbin sleeve is secured in position with the aid of two rubber rings. This is a very expensive construction, requiring in each case a hydraulic or pneumatic chucking device and braking device. The release of the full bobbin and the clamping of the empty bobbin sleeve occur automatically in lifting off the bobbin from the drive roller or in adding on the empty sleeve. Such devices tend to suffer from frequent mechanical failures which cannot be anticipated or prevented by normal maintenance of the machinery.

A recent chuck assembly for textile bobbins is disclosed in U.S. Pat. No. 4,202,507, issued May 13, 1980, wherein the problems in this art are to be solved by using two rubber O-rings, one at the inboard end and the other at the outboard end of the chuck, the inboard O-ring actuating the outboard O-ring over a set of two-armed levers, the two O-rings being pressed between the inner surface of the sleeve and a circumferentially grooved segment of the chuck shaft. The use of mechanical levers set into the chuck shaft is still relatively complicated and is subject to fouling as well as general maintenance problems.

SUMMARY OF THE INVENTION

The problem of providing an effective, easily maintained and relatively inexpensive self-tightening chuck or sleeve holder is solved in a particularly satisfactory manner by the present invention, especially in textile machines or the like in which a sleeve holder is carried conventionally on the machine by a rotary, cantilevered shaft with a machine-side stop means for the sleeve, i.e. a stop means at the inboard receiving end of the chuck assembly.

In its broadest aspect, the self-tightening sleeve holder of the invention comprises (1) a tube member which is axially slidable on the rotary, cantilevered shaft between the stop means and a collar member rigidly fixed to the shaft, a plurality of axially elongated linking members on said tube member extending through a corresponding plurality of axial openings in said collar to hold a push means arranged about the shaft in front of the collar, (2) a first machine-side gripping ring arranged on the circumference of the tube member in a position to be pushed and frictionally engaged by the sleeve, during slipping of the sleeve onto said tube member, from a small diameter bed over a roll surface which mounts in the push direction and then into a larger diameter bed where said first ring tightly secures the sleeve to the tube member, and (3) a second gripping ring arranged on the circumference of the collar member in a position to be moved by said push ring and placed in frictional contact with said sleeve, said movement taking place from a small diameter bed over a roll surface which mounts in the push direction and then into a larger diameter bed where said second ring also tightly secures the sleeve to the tube member.

The invention further provides an accumulator means interposed between the slidable tube member and the stop means to act resiliently against the force used for pushing the tube member axially toward the stop means. This accumulator means preferably comprises a compression spring, e.g. in the form of a coil spring or plurality of coil springs which can be mounted in opposing recesses in the facing end surfaces of the tube member and the stop means, thereby separating the tube member from the stop means and resiliently pushing them apart.

A number of advantages and improvements are achieved with the self-tightening sleeve holder of the invention as described more fully hereinafter together with the attached drawings which illustrate the preferred embodiments of the invention without any intention of limiting the invention to these particular embodiments.

THE DRAWINGS

DESCRIPTION OF THE PREFERRED EMBODIMENTS

Figure 1:
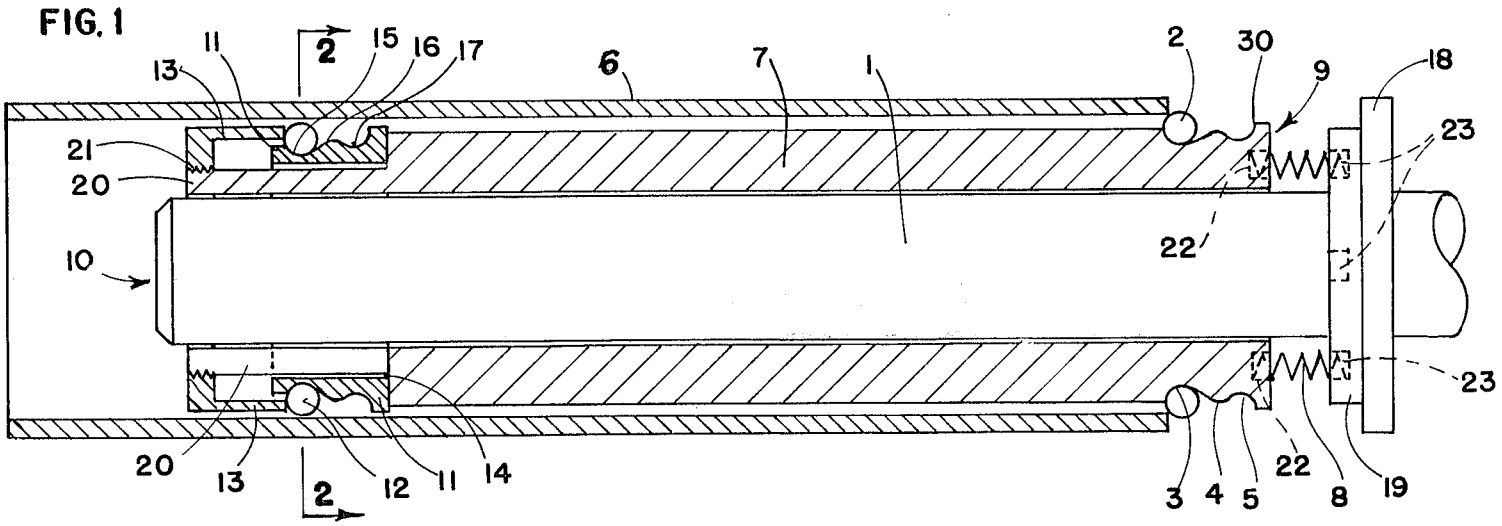
FIG. 1 is a partly schematic sectional view taken on line 1—1 of FIG. 2, illustrating one preferred embodiment of the self-tightening chuck or bobbin sleeve holder according to the invention.
Figure 2:
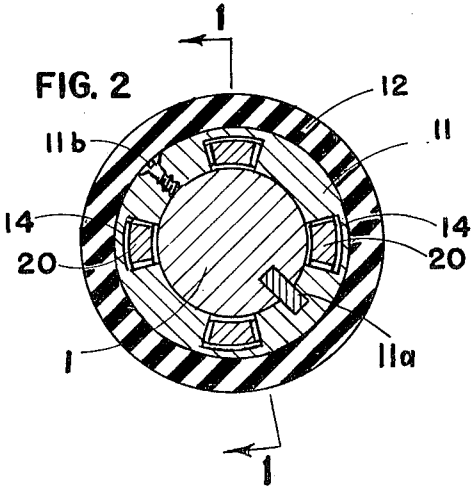
FIG. 2 is a cross sectional view taken on line 2—2 of FIG. 1 with the bobbin sleeve being omitted.

Referring to FIGS. 1 and 2, the self-tightening sleeve holder of the invention is illustrated at one high speed winding position to a textile machine for taking up a thread onto a bobbin package, using a conventional elongated, cantilevered shaft 1 mounted on the machine side or inner end in suitable bearings (not shown) for rotation about its longitudinal axis. Near the free or outer end 10 of this rotary shaft 1, a shaped or profiled collar 11 is attached in a fixed position, i.e. without movement longitudinally or circumferentially with respect to the shaft 1 by means of a key and slot arrangement 11*a* and/or at least one set screw 11*b* as indicated in FIG. 2. A feather key as an axially elongated member may also be inserted in slot 11*a* and an opposing slot of similar shape and size in the collar 11 and also in the tube 7 (not shown). Collar 11 can be easily replaced by a differently profiled collar for adaptation to different sizes or weights of bobbin sleeves and their yarn packages.

The profiled collar 11 is shaped in such a way as to provide on its circumference two axially consecutive beds or grooves 15 and 17 which provide an outer open position and an inner closed or locked position, respectively, for a rubber gripping ring 12 (hereinafter to be identified as the second of two gripping rings) in the loading and unloading of a bobbin sleeve 6 onto the shaft 1. The beds 15 and 17 are nearly semi-circular in cross section, and each bed exhibits a different root diameter in seating the gripping ring 12. The first bed 15 is of smaller diameter, being sufficiently small that the outer diameter of the gripping ring 12 seated therein is less than the inner diameter of the bobbin sleeve 6 being pushed onto the chuck assembly (to the right). Thus, when this sleeve 6 is initially pushed onto the shaft 1 over the fixed collar 11, it rides freely over the gripping ring 12 inserted in the first bed 15.

The second bed 17, having a larger root diameter than the first bed 15, is joined with said first bed by a circumferential hump or rolling surface 16 which mounts or ascends in the initial push direction with at least a small portion of this rolling surface 16 being of larger diameter than the root diameter of the second bed 17, thereby ensuring a secure locking of the ring 12 in the second bed 17. The rolling surface 16 is preferably smoothly rounded in forming a circumferential hump or bulge around the collar 11 so that the rubber ring 12 will be rolled or slidingly urged without damage from bed 15 over hump 16 and then into bed 17 where a secure, friction-type locking is produced between the profiled collar 11 and the bobbin sleeve 6.

The profiled collar contains a plurality of openings 14 at positions which are preferably equidistantly spaced around the circumference of the collar as viewed in cross section (FIG. 2). With the aid of the axially elongated linking members or fingers 20, which are finger-like extensions of the push tube member 7, a fixed connection is made with the push ring 13 so that it will slide back and forth together with the tube member 7. This fixed connection is preferably accomplished by threading the push ring 13 onto mating threads 21 in the fingers 20, or by at least one set screw similar to 11*b* but connecting the ring 13 to the fingers 20. The push ring can then be removed and suitably replaced with a different push ring adapted to varying sizes or weights of the bobbin sleeves and packages. The function of the push tube 7 with its push ring 13 will be apparent from the description of the chucking operation given below.

At its machine-side or inboard end, the shaft 1 carries a fixed stop member 18 which preferably has an added shoulder or outwardly facing support member 19 as a means to center the bobbin sleeve 6. The outer diameter of the shoulder support member 19 is thus preferably adapted to fit within the inner diameter of the sleeve 6.

A push tube 7 acts as a single axially slidable unit in performing a chucking function and is preferably proportioned so that it can be axially shifted with only a little play on the shaft 1, the fingers 20 being in sliding contact with the openings 14 of the fixed collar 11 so that the tube 7 also has just a little play in the circumferential direction. Rotation of the push tube 7 together with the shaft 1 is thereby guaranteed without depending upon any other connecting or chucking means for this purpose.

At its inboard end, the push tube 7 as shown in FIG. 1 also has two approximately semicircular grooves 3 and 5 which extend around the circumference of the tube and are smoothly connected by the rolling surface 4 to provide an outer sleeve engaging position and an inner closed or locking position, similar to the arrangement on the shaped collar 11. In this case, however, the outermost groove or smaller diameter bed 3 has a root diameter in seating the first rubber gripping ring 2 which is still sufficiently large so that the outer diameter of this gripping ring 2 is larger than the inner diameter of the bobbin sleeve 6. When initially pushing the sleeve 6 onto the tube 7, it will engage the first gripping ring 2 and roll or slide it over the rolling surface 4 and then into its locking position in the larger diameter bed 5.

A compression spring means in the form of a plurality of coil springs 8, preferably at least three such springs or four as illustrated, are inserted between the inner facing end 9 of the push tube 7 and the outer facing end surface of the stop means 18. The mounting of these springs 8 is most easily accomplished by providing one set of cylindrical recesses 22 spaced equidistantly about the circumference of the face end of the push tube 7 and a corresponding set of cylindrical recesses 23 in the opposite face of the centering support member 19. Each recess is adapted to receive one end of a coil spring and also acts as a guide for the compressed and expanded coils. The function of these coil springs is described more fully below.

As noted above, the openings 14 in the fixed collar 11 permit a rigid connection or linkage between the main barrel or body of the push tube 7 and the push ring 13 by means of the extending fingers 20 of tube 7 which pass through openings 14 to be fastened to the push ring 13. Therefore, when the first gripping ring 2 is engaged by the bobbin sleeve 6 and pushed inwardly out of bed 3 over hump 4 and into bed 5, the push tube 7 is caused to move toward the stop member 18 and at the same time the push ring 13 engages the second gripping ring 12 to push it inwardly out of bed 15 over hump 16 and into bed 17. The movement of the two gripping rings 2 and 12 is thus actuated by the force of pushing sleeve 6 onto the chuck or sleeve holder, both of these gripping rings being pushed forwardly in tandem. The pushing ring 13 in its outermost or loading position is preferably arranged concentrically around the shaft 1 and directly adjacent to the outermost bed 15 in collar 11. Only a short inward axial thrust is then required to move both gripping rings into their innermost locking beds 17 and 5, respectively.

Figure 3:
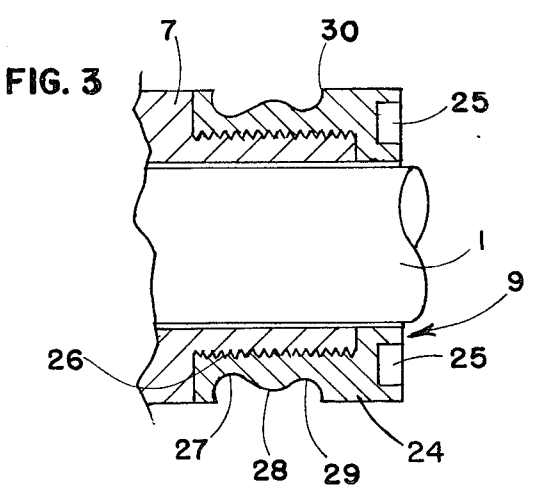
FIG. 3 is a partial sectional view at the inner end of the sleeve holder to illustrate an alternative construction of the chuck assembly according to the invention.

In FIG. 3, the inner end 9 of the push tube 7 is also equipped with a replaceable collar piece 24 containing four equidistantly spaced recesses 25 to mount the coil springs (not shown) and being fastened to the tube by the mating threads 26. A first circumferentially grooved bed 27 of smaller root diameter is connected to a second bed 29 of larger root diameter over the hump or rolling surface 28 in the same manner as the beds 3, 5 and hump 4 of FIG. 1 except that the shape and configuration of these parts is varied to accomodate a different sleeve or a different rubber gripping ring.

In general, this collar piece 24 will preferably have a profiled outer circumference closely matching that of the fixed collar member 11, especially so as to provide about the same gripping or locking effect in the innermost beds 29 and 17 in cooperation with their respective first and second gripping rings. The frictional locking force will then be approximately equal at both ends of the bobbin sleeve 6 and the self-tightening characteristics will also be about equal with the outwardly exerted gripping pressure being spread over the circumferential area of contact between the gripping rings and the inner surface area of the sleeve.

The automatic function and operation of the chuck or sleeve holder of the invention is basically the same in all embodiments of the invention and will be readily understood with reference to the drawings and especially FIG. 1 where the sleeve 6 is shown after being slipped onto the shaft 1 over the push tube 7 just before engaging the gripping ring 2.

When an empty bobbin sleeve 6 is shoved or slipped from the free end 10 of shaft 1 onto the slf-tightening sleeve holder up to the position shown in FIG. 1, it will slide practically free of contact with the second or outermost gripping ring 12 which is seated in the first smaller bed 15 of collar 11.

Both the first and second rings 2 and 12 rest securely in their outermost beds since they are made of rubber or a similar elastomeric material which can contract or expand in diameter will also being resiliently compressed when being squeezed between the outer profiled surfaces on the tube 7 or collar 11 and the inner surfaces of the bobbin sleeve 6. These gripping rings preferably have a round cross section, i.e. in the form of typical O-rings, and are made of any suitably soft rubber or other highly elastic material.

After reaching the position shown in FIG. 1, the bobbin sleeve 6 is pushed either manually or by a loading device in axial direction toward the stop member 18. This causes the first gripping ring 2 to be engaged by the inner end of the sleeve 6 so as to roll or push the ring 2 along the smooth rolling surface 4 and into the bed 5, simultaneously compressing the rubber ring between the tube 7 and inner wall surface of the sleeve 6. Through this movement, the frictional contact of the ring 2 between tube 7 and sleeve 6 becomes sufficiently strong or intensive as the ring 2 rides up the increasing diameter of the rolling surface 4 and into larger diameter bed 5 so that the further axial pushing of the sleeve 6 inwardly toward stop member 18 causes the push tube to be driven in the same direction against the action of the springs 8. At this movement, however, the push ring 13 is also moved with the help of fingers 20 so as to be advanced toward the stop member 18 and to become engaged with and push the second gripping ring out of bed 15 to roll or slide over the rolling surface 16 until it locks or catches in the bed 17. In this manner, a secure frictional connection is made between the sleeve holder and the bobbin sleeve.

The coil springs 8 used as an accumulator means in the illustrated embodiments have an important function. In the loading operation described above, the bobbin sleeve 6, as it is pushed onto the shaft and tubular support means of the chuck, comes into contact with the gripping ring 2 and pushes it over the hump or roller surface 4 into bed 5 without too great a consumption of energy or any need to provide too great a force. However, once the first gripping ring 2 becomes seated in bed 5, the frictional coupling between the push tube 7 and bobbin sleeve 6 becomes so secure or tight that the push tube is now taken along from its position shown in FIG. 1 toward the stop member 18 against the action of the springs 8. Thus, there is a first movement axially inwardly of the gripping ring 2 from bed 3 into bed 5 and only when is sufficient force exerted to move the entire push tube 7 axially inwardly against coil springs 8. The innermost lip 30 of the bed 5 is steep enough and/or high enough to prevent the gripping ring 2 from being dislodged and carried off the inner end 9 of the push tube 7.

As the push tube 7 moves axially inwardly in the loading direction, the push ring 13 presses the second or outermost gripping ring 12 out of its first small bed 15 into the larger bed 17. At the same time, this second locking movement of ring 12 provides enough additional frictional contact with the sleeve 6 to further compress the springs 8 between the stop member 18 and the push tube 7.

The intervals between the inner end 9 of the push tube and the stop 18 as well as the intervals between the beds 15 and 17 are determined such that the bobbin sleeve rests on the stop 18 when the gripping ring 12 has been inserted into the locking position of the larger bed 17. In general, the maximum intervals which correspond to the travel stroke of the compression spring means, e.g. coil springs 8, amounts to about 3 to 15 mm and preferably about 5 to 8 mm in typical textile machines using conventional bobbin sleeves.

It is important to design the compression spring means or other accumulator means such that the spring force or the force of accumulator resistance exceeds that force which is initially required to push the first gripping ring 2 into its larger diameter bed 5, but remains less than that force which would move or dislodge the second gripping ring 12 out of its larger diameter bed 17 once pushed into this inner closed or locking position.

In withdrawing or pulling off a full bobbin after completion of the usual winding operation, relatively less force is required to move the two gripping rings 2 and 12 from their beds of larger diameter 5 and 17 into their beds of smaller diameter 3 and 15, respectively. The closed or locked position in which the bobbin sleeve is securely held by the two gripping rings thus remains secure even during starting and stopping the winding, but at the same time excessive force is not needed to remove a full bobbin package or to slip on an empty bobbin sleeve.

In addition to providing a secure gripping of the bobbin sleeve at all stages of the winding operation, the automatic chuck or sleeve holder of the present invention has the advantage of a very simple and inexpensive construction. Also, a very minimal amount of time is needed for exchanging bobbins so as to reduce the accumulation of waste threads. Aside from the cooperating push tube and push ring and the two gripping rings there are no moving parts which can malfunction or become worn over long periods of use.

Most importantly, there are essentially only two locking members subject to wear, namely the rubber or elastomeric gripping rings, and these lie openly for inspection after removal or discharge of the fully wound bobbin and before insertion of an empty bobbin sleeve. These rings, e.g. as simple rubber O-rings, are inexpensive and can be easily replaced as needed. Finally, the fully closed and smoothly profiled circumferential surfaces of the chuck assembly avoid any accumulation of fiber dust or other fouling material, and all parts are very quickly and easily cleaned because all exposed surfaces are readily accessible as well as being highly visible for inspection. Operating disturbances are quite minimal, thereby greatly increasing the efficiency of winding operations.

The invention is hereby claimed as follows:

1. A self-tightening sleeve holder carried on a machine by a rotary, cantilevered shaft with a machine-side stop means for the sleeve, said holder comprising:

a tube member axially slidable on said shaft between said stop means and a collar member rigidly fixed to the shaft, a plurality of axially elongated linking members on said tube member extending through a corresponding plurality of axial openings in said collar;

push means arranged about the shaft in front of the collar and carried on said linking means;

a first machine-side gripping ring arranged on the circumference of the tube member in a position to be pushed and frictionally engaged by the sleeve, during slipping of the sleeve onto said tube member, from a small diameter bed over a roll surface which mounts in the push direction into a larger diameter bed where said first ring tightly secures the sleeve to the tube member; and a second gripping ring arranged on the circumference of the collar member in a position to be moved by said push means and placed in frictional contact with said sleeve, said movement taking place from a small diameter bed over a roll surface which mounts in the push direction into a larger diameter bed where said second ring also tightly secures the sleeve to the tube member.

2. A self-tightening sleeve holder as claimed in claim 1 including an accumulator means interposed between said tube member and said stop means to store energy when pushing said tube member axially toward the stop means.

3. A self-tightening sleeve holder as claimed in claim 2 wherein said accumulator means is a compression spring separating said tube member from said stop means.

4. A self-tightening sleeve holder as claimed in claim 1, 2 or 3 wherein each of said gripping rings is an elastomeric material having a round cross section.

5. A self-tightening sleeve holder as claimed in claims 1, 2 or 3 wherein each of said beds is an approximately semi-circular groove in the circumferential surface of the tube and collar members, repectively; the small diameter of the first bed on the collar, viewed in the push direction, is proportioned such that the outer diameter of the gripping ring seated therein is smaller than the inner diameter of the sleeve; and the larger diameter of the second bed on the collar member, viewed in the push direction, is proportioned such that the outer diameter of the gripping ring seated therein is larger than the inner diameter of the sleeve.

6. A self-tightening sleeve holder as claimed in claim 1 wherein the tube member is shiftably mounted on said shaft to provide an easily sliding fit.

7. A self-tightening sleeve holder as claimed in claim 3 wherein the compression spring is a coil spring.

8. A self-tightening sleeve holder as claimed in claim 3 wherein the maximum travel stroke of the compression spring is about 3 to 15 mm.

9. A self-tightening sleeve holder as claimed in claim 3 wherein the maximum travel stroke of the compression spring is about 5 to 8 mm.

10. A self-tightening sleeve holder as claimed in claims 3, 8 or 9 wherein the compression spring consists of at least three coil springs positioned at equidistant intervals about the circumference between the stop means and the inner facing end of the tube member, said coil springs being mounted in opposing recesses in the facing surfaces of said stop means and said tube member.

11. A self-tightening sleeve holder as claimed in claims 1, 2 or 3 wherein each of said beds is an approximately semi-circular groove in the circumferential surface of the tube and collar members, respectively; and the small diameter of the first bed on the tube member, viewed in the push direction, is proportioned such that the outer diameter of the gripping ring seated therein is larger than the inner diameter of the sleeve.

12. A self-tightening sleeve holder as claimed in claims 1, 2 or 3 wherein each of said beds is an approximately semi-circular groove in the circumferential surface of the tube and collar members, respectively; and the smaller diameter bed of the second gripping ring on the collar member has a diameter which is smaller than the small diameter bed on the tube member.

13. In a textile machine having a self-tightening sleeve holder for releasably mounting a bobbin sleeve on a rotatable, elongated, cantilever supported shaft having stop means for the sleeve at an inboard receiving end, the improvement in said holder comprising:

a tube member adapted to fit loosely within the sleeve to be mounted thereon, said tube member being axially slidable on said shaft with an accumulator means operatively connecting the inner end of the tube member with said stop means and acting to store energy when pushing the tube member axially toward the stop means during mounting of the sleeve;

a first elastomeric gripping ring positioned toward the inner end of the tube member and axially shiftable along the circumferential surface of the tube member by frictional engagement with the inner surface of the sleeve from a first circumferentially grooved bed of a diameter sufficient to place the ring in the path of the sleeve, over a first roll surface which increases in diameter in the push direction during mounting of the sleeve and into a second circumferentially grooved bed of larger diameter than said first bed where the inner surface of the sleeve is securely held by said gripping ring;

a collar member rigidly fixed to said shaft toward the outer end of said tube member and having a plurality of axial openings passing therethrough;

a second elastomeric gripping ring positioned on the collar member and axially shiftable along the circumferential surface of the collar member from a first circumferentially grooved bed of a diameter small enough to retain the gripping ring inside the path of the sleeve, over a second roll surface which increases in diameter in the push direction during mounting of the sleeve so as to expand said gripping for frictional engagement with said sleeve and into a second circumferentially grooved bed of larger diameter than said first bed where the inner surface of the sleeve is also securely held by said second gripping ring;

push means arranged about the shaft toward its outer end in a radially extended position to push said second gripping ring axially from its first bed on said collar into engagement with said sleeve during mounting of the sleeve; and a plurality of axially extending fingers on said tube member arranged to pass slidingly through the corresponding plurality of axial openings in said collar for linkage with said push means, thereby causing said push means to act on said second gripping ring as the sleeve engages the first gripping ring and moves the tube member linked with said push means axially inwardly against the action of said accumulator means.

* * * * *